US009918546B2

(12) United States Patent
Smith

(10) Patent No.: US 9,918,546 B2
(45) Date of Patent: Mar. 20, 2018

(54) PORTABLE TABLE SYSTEM

(71) Applicant: Michael Smith, Corona, NY (US)

(72) Inventor: Michael Smith, Corona, NY (US)

( * ) Notice: Subject to any disclaimer, the term of this patent is extended or adjusted under 35 U.S.C. 154(b) by 212 days.

(21) Appl. No.: 14/871,509

(22) Filed: Sep. 30, 2015

(65) Prior Publication Data

US 2017/0086576 A1 Mar. 30, 2017

(51) Int. Cl.

| | |
|---|---|
| ***A45C 5/06*** | (2006.01) |
| ***A47B 23/06*** | (2006.01) |
| ***A45C 13/28*** | (2006.01) |
| ***A45C 13/26*** | (2006.01) |

(52) U.S. Cl.

CPC ..... *A47B 23/06* (2013.01); *A45C 5/06* (2013.01); *A45C 13/262* (2013.01); *A45C 13/28* (2013.01)

(58) Field of Classification Search

CPC ..... A47B 23/06; A45C 5/06; A45C 13/262; A45C 13/28

See application file for complete search history.

(56) References Cited

U.S. PATENT DOCUMENTS

| | | | | |
|---|---|---|---|---|
| 1,554,245 | A | 9/1925 | Walczak | |
| 1,786,607 | A | 12/1930 | Gunchick | |
| D107,711 | S | 12/1937 | Wilt | |
| 2,640,747 | A * | 6/1953 | Bodenhoff | A47B 23/00 108/43 |
| 2,746,821 | A * | 5/1965 | Schroeder | B60N 3/005 108/166 |
| 3,557,916 | A | 1/1971 | Stowell | |
| 4,357,881 | A * | 11/1982 | De Long | A47B 23/02 108/135 |
| 5,320,321 | A * | 6/1994 | Muncada | B60N 3/005 248/443 |
| 5,411,192 | A | 5/1995 | Xiao | |
| 5,529,322 | A | 6/1996 | Barton | |
| 5,941,352 | A | 8/1999 | Lee | |
| 6,105,508 | A | 8/2000 | Ryburg | |
| 6,408,769 | B1 * | 6/2002 | Lewis | B60N 3/005 108/44 |
| 6,471,019 | B1 | 10/2002 | Miller | |
| 6,494,148 | B1 * | 12/2002 | Mullaney | B60N 3/005 108/44 |
| 6,736,073 | B2 * | 5/2004 | Ryburg | A45C 7/00 108/42 |
| 9,282,795 | B2 * | 3/2016 | King | A45C 9/00 |
| 9,554,643 | B2 * | 1/2017 | Nelson | A47B 5/02 |
| 2008/0134946 | A1 * | 6/2008 | Alonso | A45C 9/00 108/50.11 |
| 2010/0236884 | A1 * | 9/2010 | Brown | A45C 9/00 190/11 |
| 2012/0217109 | A1 | 8/2012 | King et al. | |
| 2012/0273314 | A1 * | 11/2012 | Raymond | A45C 13/28 190/18 A |
| 2013/0032443 | A1 * | 2/2013 | Soedomo | 190/11 |

(Continued)

*Primary Examiner* — Tri Mai

(57) ABSTRACT

A portable table system includes an article of luggage that has a handle and the handle has a pair of uprights. A table is removably coupled to the handle such that the table may support an object. The table is collapsible such that the table is stored in the luggage. A pair of supports is provided and each of the supports is coupled to the table. Each of the supports is removably coupled to the handle such that the table is retained in a horizontal orientation.

5 Claims, 4 Drawing Sheets

(56) References Cited

U.S. PATENT DOCUMENTS

| | | | | |
|---|---|---|---|---|
| 2014/0238799 | A1* | 8/2014 | Sharma | B62B 1/125<br>190/11 |
| 2016/0022032 | A1* | 1/2016 | Simon | A45C 13/28<br>108/42 |
| 2016/0037905 | A1* | 2/2016 | Glover | A47B 3/10<br>108/42 |

* cited by examiner

PORTABLE TABLE SYSTEM

BACKGROUND OF THE DISCLOSURE

Field of the Disclosure

The disclosure relates to table devices and more particularly pertains to a new table device for being removable coupled to an article of luggage.

SUMMARY OF THE DISCLOSURE

An embodiment of the disclosure meets the needs presented above by generally comprising an article of luggage that has a handle and the handle has a pair of uprights. A table is removably coupled to the handle such that the table may support an object. The table is collapsible such that the table is stored in the luggage. A pair of supports is provided and each of the supports is coupled to the table. Each of the supports is removably coupled to the handle such that the table is retained in a horizontal orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
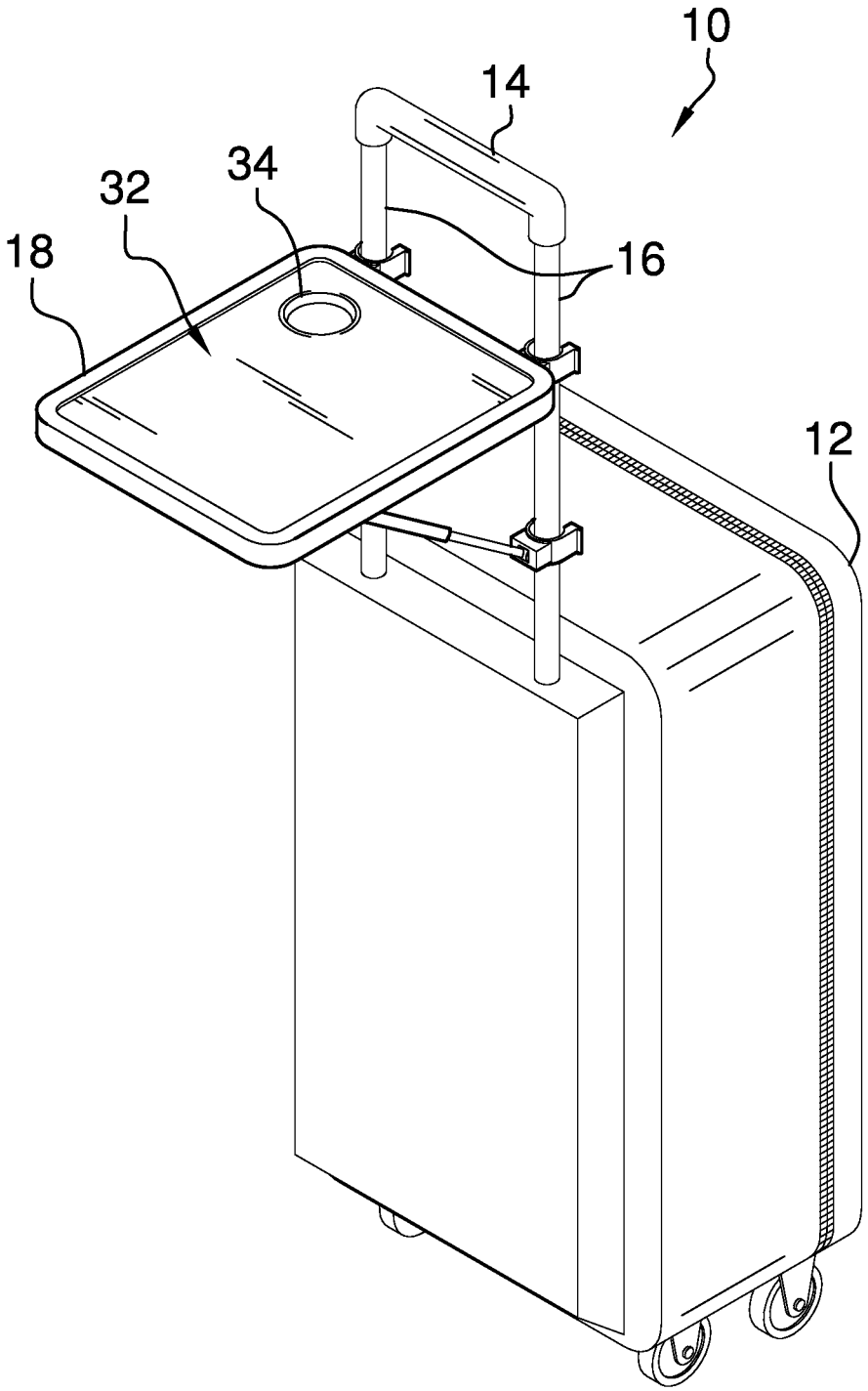
FIG. 1 is a perspective view of a portable table system according to an embodiment of the disclosure.
Figure 2:
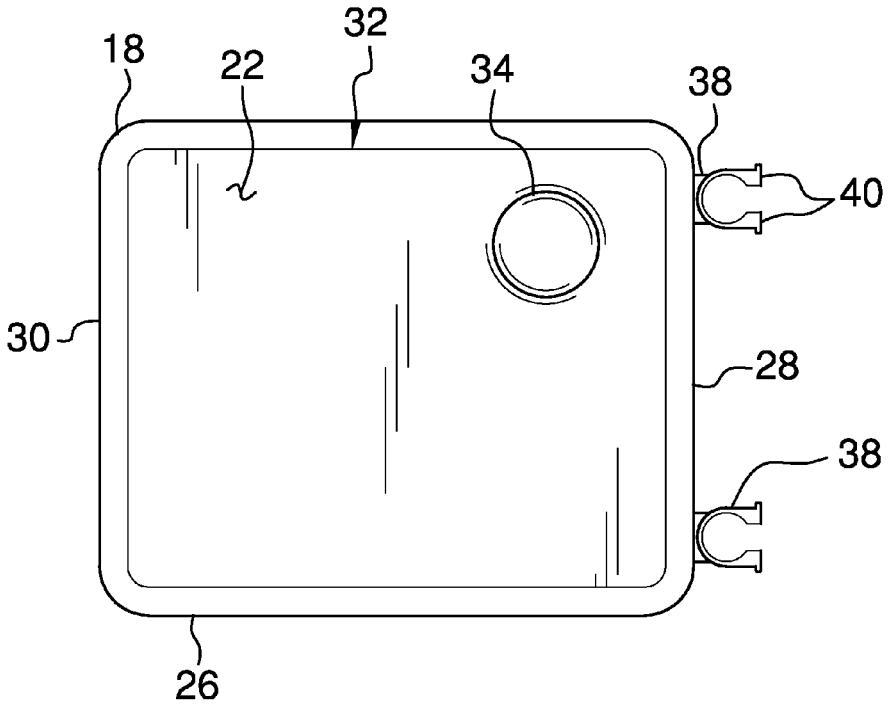
FIG. 2 is a top view of an embodiment of the disclosure.
Figure 3:
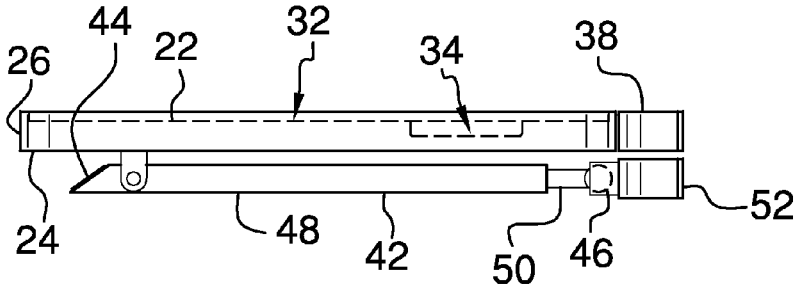
FIG. 3 is a right side view of an embodiment of the disclosure.
Figure 4:
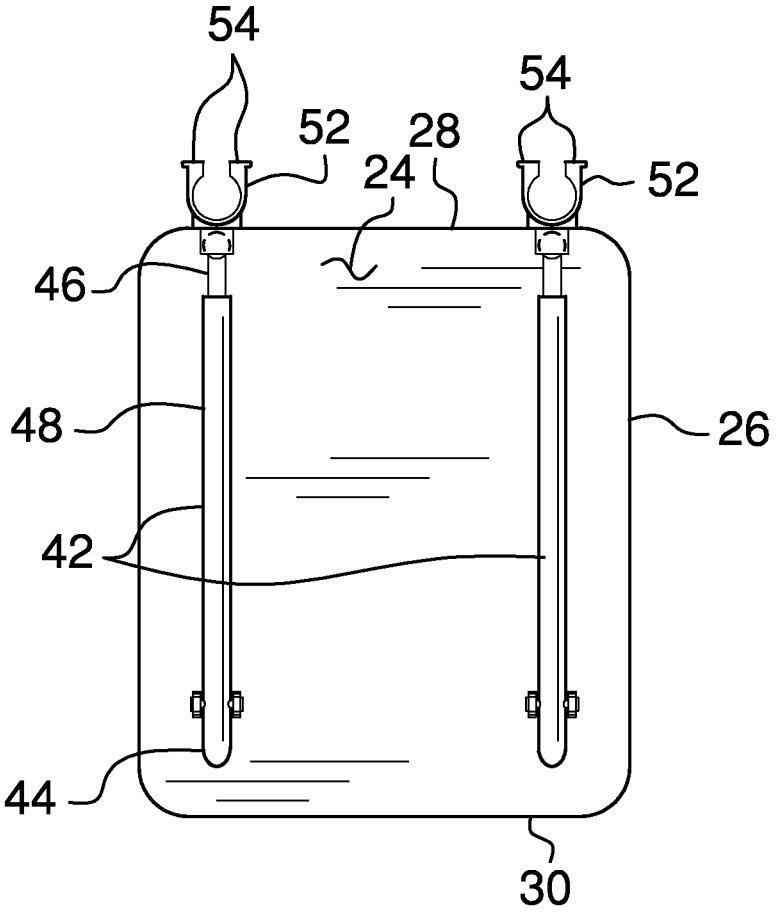
FIG. 4 is a bottom view of an embodiment of the disclosure.
Figure 5:
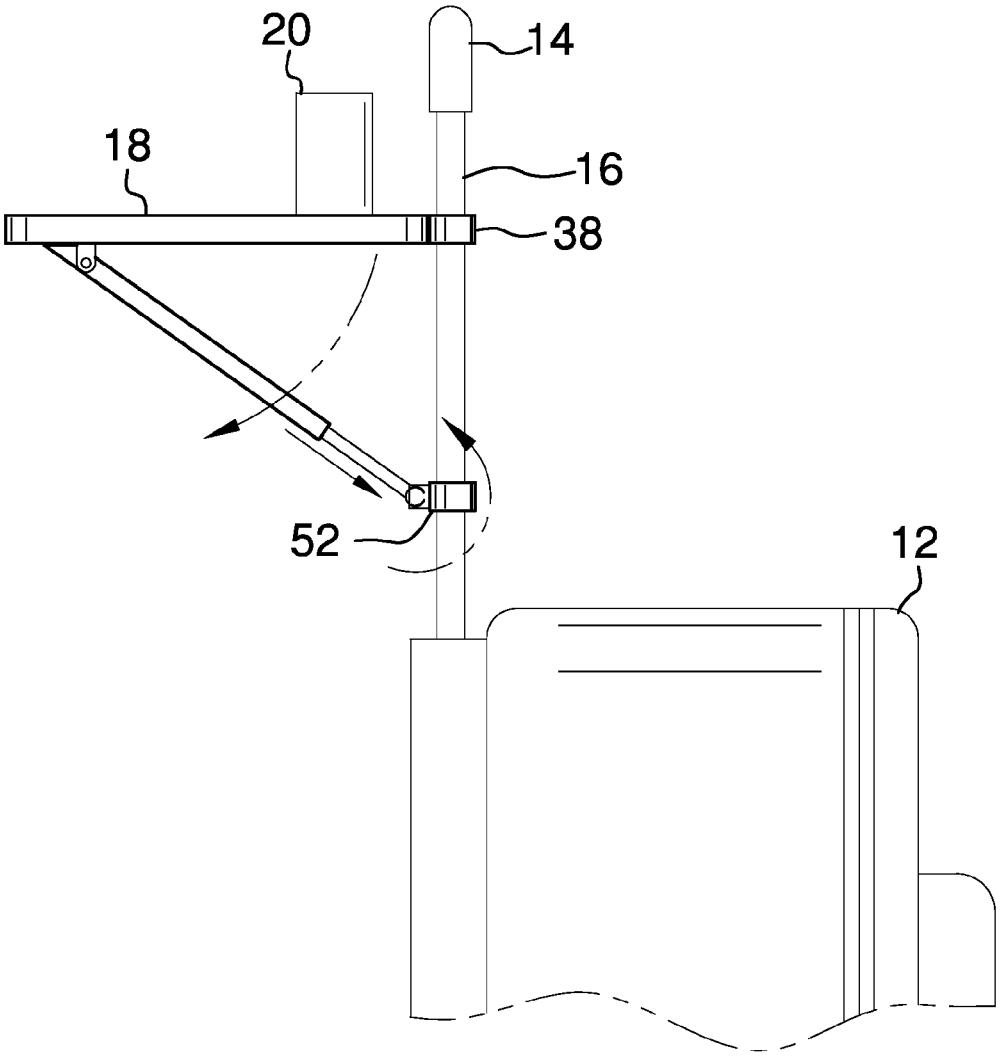
FIG. 5 is a right side perspective view of an embodiment of the disclosure.

With reference now to the drawings, and in particular to FIGS. 1 through 5 thereof, a new table device embodying the principles and concepts of an embodiment of the disclosure and generally designated by the reference numeral 10 will be described.

As best illustrated in FIGS. 1 through 5, the portable table system 10 generally comprises an article of luggage 12 that has a handle 14. The handle 14 has a pair of uprights 16 and the article of luggage 12 may comprise wheeled luggage or the like. A table 18 is removably coupled to the handle 14 such that the table 18 may support an object 20. The table 18 is collapsible such that the table 18 is stored in the article of luggage 12. The object 20 may be a food item, a laptop computer or other object.

The table 18 has a top surface 22, a bottom surface 24 and a peripheral edge 26 extending between the top surface 22 and the bottom surface 24. The top surface 22 may have the object 20 positioned thereon. The peripheral edge 26 has a back side 28 and a front side 30. The top surface 22 has a recessed portion 32 and the recessed portion 32 inhibits the object 20 from sliding off of the top surface 22. The top surface 22 has a well 34 extending downwardly therein and the well 34 may contain a container 36. The container 36 may be a beverage container or the like and the well 34 is positioned on the recessed portion 32.

A pair of first clips 38 is provided and each of the first clips 38 has a pair of arms 40. The arms 40 are spaced apart from each other. Each of the first clips 38 is coupled to the back side 28 of the table 18 having the arms 40 extending away from the table 18. The first clips 38 are spaced apart from each other. Each of the first clips 38 frictionally engages an associated one of the uprights 16 such that the table 18 is removably coupled to the handle 14. Each of the uprights 16 is positioned between the arms 40 of an associated one of the first clips 38.

A pair of supports 42 is provided and each of the supports 42 is coupled to the table 18. Each of the supports 42 is removably coupled to the handle 14 such that the table 18 is retained in a horizontal orientation. Each of the supports 42 has a first end 44 and a second end 46. Each of the supports 42 has a first section 48 that is slidably coupled to a second section 50 such that each of the supports 42 has a telescopically adjustable length. The first end 44 of each of the supports 42 is hingedly coupled to the bottom surface 24 of the table 18.

Each of the supports 42 is positioned adjacent to the front side 30 such that each of the supports 42 extends toward the back side 28. The supports 42 are spaced apart from each other. The first end 44 of each of the supports 42 is cut at an angle with respect to a line extending through the first end 44 and the second end 46. The first end 44 of each of the supports 42 abuts the bottom surface 24 when each of the supports 42 is manipulated to angle downwardly from the bottom surface 24. Thus, each of the supports 42 is retained at an angle with respect to the bottom surface 24.

A pair of second clips 52 is provided and each of the second clips 52 has a pair of arms 54. The arms 54 of each of the second clips 52 are spaced apart from each other. Each of the second clips 52 is hingedly coupled to the second end 46 of an associated one of the supports 42. Each of the second clips 52 frictionally engages an associated one of the uprights 16 such that the table 18 is retained in the horizontal orientation. Each of the uprights 16 is positioned between the arms 54 of an associated one of the second clips 52.

In use, each of the first clips 38 is coupled to the associated upright 16. Each of the supports 42 is manipulated to extend downwardly from the table 18 thereby facilitating each of the second clips 52 to be coupled to the associated uprights 16. Each of the second clips 52 is coupled to the associated upright 16. The object 20 is placed on the table 18. The table 18 is removed from the handle 14 and the table 18 is stored within the article of luggage 12. The table 18 provides a support surface during travel.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable table system comprising:

an article of luggage having a handle, said handle having a pair of uprights;

a table being removably coupled to said handle wherein said table is configured to support an object, said table being collapsible such that said table is stored in said luggage, said table having a top surface, a bottom surface and a peripheral edge extending between said top surface and said bottom surface, said top surface being configured to have the object positioned thereon, said peripheral edge having a back side and a front side, said top surface having a recessed portion wherein said recessed portion is configured to inhibit the object from sliding off of said top surface, said table having a bottom surface, a front side and a back side;

a pair of first clips, each of said first clips having a pair of arms, said arms being spaced apart from each other, each of said first clips being coupled to said back side of said table having said arms extending away from said table, said arms being parallel to each other and laterally aligned with said table, said first clips being spaced apart from each other, each of said first clips frictionally engaging an associated one of said uprights such that said table is removably coupled to said handle;

a pair of supports, each of said supports having a first end and a second end, each of said supports being coupled to said table, each of said supports being positionable to extend from said table and be removably coupled to said handle such that said table is retained in a perpendicular orientation relative to said handle; and a pair of second clips, each of said second clips having a pair of arms, said arms of each of said second clips being spaced apart from each other, each of said second clips being hingedly coupled to said second end of an associated one of said supports wherein each of said second clips is pivotable relative to said associated one of said supports, each of said second clips frictionally engaging an associated one of said uprights such that said table is retained in said horizontal orientation.

2. The system according to claim 1, wherein said top surface has a well extending downwardly therein wherein said well is configured to contain a container, said well being positioned on said recessed portion.

3. The system according to claim 1, wherein each of said supports has a first section being slidably coupled to a second section such that each of said supports has a telescopically adjustable length, said first end of each of said supports being hingedly coupled to said bottom surface of said table, each of said supports being positioned adjacent to said front side such that each of said supports extends toward said back side, said supports being spaced apart from each other.

4. The system according to claim 3, wherein said first end of each of said supports is cut at an angle with respect to a line extending through said first end and said second end, said first end of each of said supports abutting said bottom surface when each of said supports is manipulated to angle downwardly from said bottom surface such that each of said supports is retained at an angle with respect to said bottom surface.

5. A portable table system comprising:

an article of luggage having a handle, said handle having a pair of uprights; and a table being removably coupled to said handle wherein said table is configured to support an object, said table being collapsible such that said table is stored in said luggage, said table having a top surface, a bottom surface and a peripheral edge extending between said top surface and said bottom surface, said top surface being configured to have the object positioned thereon, said peripheral edge having a back side and a front side, said top surface having a recessed portion wherein said recessed portion is configured to inhibit the object from sliding off of said top surface, said top surface having a well extending downwardly therein wherein said well is configured to contain a container, said well being positioned on said recessed portion;

a pair of first clips, each of said first clips having a pair of arms, said arms being spaced apart from each other, each of said first clips being coupled to said back side of said table having said arms extending away from said table said arms being parallel to each other and laterally aligned with said table, said first clips being spaced apart from each other, each of said first clips frictionally engaging an associated one of said uprights such that said table is removably coupled to said handle;

a pair of supports, each of said supports being coupled to said table, each of said supports being removably coupled to said handle such that said table is retained in a horizontal orientation, each of said supports having a first end and a second end, each of said supports having a first section being slidably coupled to a second section such that each of said supports has a telescopically adjustable length, said first end of each of said supports being hingedly coupled to said bottom surface of said table, each of said supports being positioned adjacent to said front side such that each of said supports extends toward said back side, said supports being spaced apart from each other, said first end of each of said supports being cut at an angle with respect to a line extending through said first end and said second end, said first end of each of said supports abutting said bottom surface when each of said supports is manipulated to angle downwardly from said bottom surface such that each of said supports is retained at an angle with respect to said bottom surface; and a pair of second clips, each of said second clips having a pair of arms, said arms of each of said second clips being spaced apart from each other, each of said second clips being hingedly coupled to said second end of an associated one of said supports wherein each of said second clips is pivotable relative to said associated one of said supports, each of said second clips frictionally engaging an associated one of said uprights such that said table is retained in said horizontal orientation.

* * * * *